US009920446B2

(12) United States Patent
Penning et al.

(10) Patent No.: US 9,920,446 B2
(45) **Date of Patent: *Mar. 20, 2018**

(54) POLYMER COATED SUBSTRATE FOR PACKAGING APPLICATIONS AND A METHOD FOR PRODUCING SAID COATED SUBSTRATE

(71) Applicant: TATA STEEL IJMUIDEN BV, Velsen-Noord (NL)

(72) Inventors: Jan Paul Penning, Den Haag (NL); Jacques Hubert Olga Joseph Wijenberg, Amsterdam (NL); Ilja Portegies Zwart, Wormer (NL)

(73) Assignee: TATA STEEL IJMUIDEN BV, Velsen-Noord (NL)

( * ) Notice: Subject to any disclaimer, the term of this patent is extended or adjusted under 35 U.S.C. 154(b) by 802 days.

This patent is subject to a terminal disclaimer.

(21) Appl. No.: 14/388,130

(22) PCT Filed: Apr. 10, 2013

(86) PCT No.: PCT/EP2013/057504

§ 371 (c)(1),
(2) Date: Sep. 25, 2014

(87) PCT Pub. No.: WO2013/153123

PCT Pub. Date: Oct. 17, 2013

(65) Prior Publication Data

US 2015/0037604 A1 Feb. 5, 2015

(30) Foreign Application Priority Data

Apr. 11, 2012 (EP) ..... 12163768

(51) Int. Cl.

| | |
|---|---|
| ***C25D 5/50*** | (2006.01) |
| ***C25D 5/36*** | (2006.01) |
| ***C25D 9/10*** | (2006.01) |
| ***C25D 3/04*** | (2006.01) |
| ***C25D 3/10*** | (2006.01) |
| ***C25D 3/30*** | (2006.01) |
| ***C25D 7/06*** | (2006.01) |
| ***C25D 9/02*** | (2006.01) |
| ***B05D 7/14*** | (2006.01) |
| *C25D 3/06* | (2006.01) |
| *B05D 3/02* | (2006.01) |

(52) U.S. Cl.

CPC ..... *C25D 5/50* (2013.01); *B05D 7/14* (2013.01); *C25D 3/04* (2013.01); *C25D 3/10* (2013.01); *C25D 3/30* (2013.01); *C25D 5/36* (2013.01); *C25D 5/505* (2013.01); *C25D 7/0614* (2013.01); *C25D 9/02* (2013.01); *C25D 9/10* (2013.01); *B05D 3/0218* (2013.01); *B05D 2252/10* (2013.01); *B05D 2350/63* (2013.01); *B05D 2350/65* (2013.01); *B05D 2701/00* (2013.01); *C25D 3/06* (2013.01); *Y10T 428/12542* (2015.01); *Y10T 428/12569* (2015.01)

(58) Field of Classification Search

None

See application file for complete search history.

(56) References Cited

U.S. PATENT DOCUMENTS

| | | | | |
|---|---|---|---|---|
| 3,174,917 | A | 3/1965 | Lesney et al. | |
| 4,487,663 | A | 12/1984 | Hara et al. | |
| 4,863,060 | A | 9/1989 | Saunders | |
| 5,413,645 | A * | 5/1995 | Saunders | B05D 1/28 148/518 |
| 5,555,756 | A * | 9/1996 | Fischer | B21B 45/0263 508/433 |
| 2013/0183542 | A1* | 7/2013 | Portegies Zwart | C21D 1/68 428/626 |
| 2014/0072742 | A1* | 3/2014 | Penning | B32B 15/04 428/35.8 |
| 2015/0064494 | A1 | 3/2015 | Wijenberg et al. | |

FOREIGN PATENT DOCUMENTS

| | | | | |
|---|---|---|---|---|
| FR | 2385818 | A1 | 10/1978 | |
| GB | 2186887 | A | 8/1987 | |
| WO | WO 2011020602 | A1 * | 2/2011 | B05B 3/10 |
| WO | 2012045791 | A1 | 4/2012 | |
| WO | 2013143928 | A1 | 10/2013 | |

OTHER PUBLICATIONS

International Search Report dated Jun. 21, 2013 from International Application PCT/EP2013/057504 to Tata Steel Ijmuiden BV filed Apr. 10, 2013.

* cited by examiner

*Primary Examiner* — David Sample

(74) *Attorney, Agent, or Firm* — Vorys, Sater, Seymour and Pease LLP

(57) ABSTRACT

This relates to a coated substrate for packaging applications and a method for producing the coated substrate.

21 Claims, 2 Drawing Sheets

POLYMER COATED SUBSTRATE FOR PACKAGING APPLICATIONS AND A METHOD FOR PRODUCING SAID COATED SUBSTRATE

CROSS-REFERENCE TO RELATED APPLICATIONS

This is a § 371 US National Stage Application of International Application No. PCT/EP2013/057504 filed on Apr. 10, 2013, claiming the priority of European Patent Application No. 12163768.0 filed on Apr. 11, 2012.

This invention relates to a polymer coated substrate for packaging applications and a method for producing said coated substrate.

Tin mill products include tinplate, usually as electrolytic tinplate, Electrolytic Chromium Coated Steel (ECCS, also referred to as tin free steel or TFS), and blackplate, the uncoated steel. Packaging steels are increasingly being used in the form of tinplate or ECCS onto which an organic coating is applied. In case of tinplate this organic coating is usually a lacquer whereas in case of ECCS increasingly polymer coatings such as PET or PP are used, such as in the case of Protact®.

Packaging steel is provided as single or double-reduced tin mill products generally in thicknesses of between 0.13 and 0.49 mm. A Single-Reduced (SR) tin mill product is cold-rolled directly to the finished gauge and then recrystallisation-annealed and temper rolled immediately after recrystallisation annealing. This temper rolling is intended to correct any shape defects, to introduce a certain surface texture or roughness and to prevent discontinuous yielding upon forming the substrate into a product by e.g. deep-drawing. The temper rolling eliminates yield point elongation from the tensile curve. Recrystallisation is brought about by continuous annealing or batch annealing the cold-rolled material. A Double-Reduced (DR) tin mill product is given a first cold reduction to reach an intermediate gauge, recrystallisation-annealed and then given another cold reduction to the final gauge. The resulting DR product is stiffer, harder, and stronger than SR, allowing customers to utilise lighter gauge steel in their application. These uncoated, cold-rolled, recrystallisation-annealed and optionally temper-rolled SR and DR packaging steels are referred to as blackplate. The first and second cold reduction may be given in the form of a cold-rolling reduction in a cold-rolling tandem mill usually comprising a plurality of (usually 4 or 5) rolling stands.

After annealing the SR substrate or second cold reduction of the DR substrate, the substrate is coated with the relevant metallic coating layer to produce tinplate or ECCS before being coated with a polymer coating.

After coating the SR or DR substrate with the metallic coating, the substrate has certain mechanical properties. These mechanical properties may change with the passing of time, and may change more quickly if the temperature is above ambient temperature. These higher temperatures are for instance encountered when coating the substrate with a thermoplastic polymer coating if for example the process involves preheating the substrate to 220° C., coating it and post-heating it to above 250° C. Accelerated ageing taking place at these elevated temperatures causes the yield point elongation to return. Upon forming these aged substrates into a packaging application, Lüders' lines may develop. Lüders' lines are elongated surface markings or depressions, often visible with the unaided eye, that form along the length of a specimen at an angle of approximately 45° to the loading axis. Caused by localized plastic deformation, they result from discontinuous (inhomogeneous) yielding. These Lüders' lines are aesthetically unattractive and have to be avoided on finished products It is an object of the invention to provide a polymer coated SR or DR substrate provided with an FeSn-alloy layer that is substantially free from yield point elongation.

It is also an object of the invention to provide a polymer coated SR or DR substrate provided with a Cr—CrOx coating layer that is substantially free from yield point elongation.

It is also an object of the invention to provide a polymer coated SR or DR substrate provided with an FeSn-alloy layer and a Cr—CrOx coating layer that is substantially free from yield point elongation.

One or more of these objects are reached by a process for manufacturing a polymer coated steel substrate for packaging applications, comprising the steps of:

- providing:
  - a single-reduced steel substrate, or
  - a double-reduced steel substrate which was subjected to recrystallisation annealing between the first and second cold-rolling step;
- electrodepositing a tin layer on one or both sides of the single-reduced or double-reduced steel substrate to produce a tin-coated steel substrate;
- annealing the tin-coated steel substrate at a temperature $T_a$ of at least 513° C. for an annealing time $t_a$ to convert the tin layer into an iron-tin alloy layer which contains at least 80 weight percent (wt. %) of FeSn (50 at. % iron and 50 at. % tin);
- fast cooling the iron-tin alloy coated substrate;
- providing the iron-tin alloy coated substrate with a polymer coating layer on one or both sides wherein during the polymer coating process the substrate is heated;
- subjecting the substrate to a stretching operation at any moment after the polymer coating process wherein the stretching operation is achieved by:
  - a. passing the material through a temper mill and applying a thickness reduction between 0-3%, preferably at least 0.2%; or by
  - b. passing the material through a stretcher-leveller.

Preferred embodiments are provided in the dependent claims.

The hot-rolled steel is cold-rolled to produce: i) a single-reduced (SR) steel substrate, or ii) a double-reduced (DR) steel substrate which was subjected to recrystallisation annealing between the first and second cold-rolling step. The SR steel substrate may have undergone a recrystallisation annealing.

On the cold-rolled, full-hard SR or DR substrates, or on the recrystallisation-annealed SR-substrate a layer of tin is subsequently deposited.

Substrates are called full-hard substrates if the SR-substrate has not undergone a recrystallisation annealing after cold-rolling step, and the DR-substrate has not undergone a recrystallisation annealing after the second cold-rolling step. So the microstructure of the substrate is still heavily deformed.

The inventors found that is necessary to diffusion-anneal a tin coated steel substrate at a temperature ($T_a$) of at least 513° C. to obtain the desired iron-tin coating layer. The diffusion-annealing time ($t_a$) at the diffusion-annealing temperature $T_a$ is chosen such that the conversion of the tin layer into the iron-tin layer is obtained. The intention is to fully convert the tin-layer into an iron-tin alloy and that no metallic tin layer is present after the diffusion annealing is completed. The predominant and preferably sole iron-tin alloy component in the iron-tin layer is FeSn (i.e. 50 atomic percent (at. %) iron and 50 at. % tin). It should be noted that the combination of diffusion-annealing time and temperature are interchangeable to a certain extent. A high $T_a$ and a short $t_a$ will result in the formation of the same iron-tin alloy layer than a lower $T_a$ and a longer $t_a$. The minimum $T_a$ of 513° C. is required, because at lower temperatures the desired (50:50) FeSn layer does not form. Also the diffusion-annealing does not have to proceed at a constant temperature, but the temperature profile can also be such that a peak temperature is reached. It is important that the minimum temperature of 513° C. is maintained for a sufficiently long time to achieve the desired amount of FeSn in the iron-tin diffusion layer. So the diffusion-annealing may take place at a constant temperature $T_a$ for a certain period of time, or the diffusion-annealing may, e.g., involve a peak-metal-temperature of $T_a$. In the latter case the diffusion-annealing temperature is not constant. It was found to be preferable to use a diffusion-annealing temperature $T_a$ of between 513 and 645° C., preferably of between 513 and 625° C. In case an originally full-hard steel substrate is used, the thermal treatment used to accomplish diffusion-annealing can also lead to recovery of the deformed microstructure (i.e. recovery annealing). At a lower $T_a$ this recovery process proceeds more slowly. The maximum annealing temperature is limited by the process window for forming FeSn and by the recrystallisation temperature of the deformed substrate. This separation of the recrystallisation annealing and the diffusion annealing allows the production of an SR-CA or a DR-CA material.

The FeSn alloy layer provides corrosion protection to the underlying steel substrate. This is partly achieved by shielding the substrate, as the FeSn alloy layer is very dense and has a very low porosity. Moreover, the FeSn alloy itself is very corrosion resistant by nature. Potential drawback is the fact that the FeSn alloy is also electro-catalytically active with respect to hydrogen formation, which means that the FeSn coated substrate becomes sensitive to pitting corrosion. This electro-catalytic activity can be suppressed by applying an additional (metal) coating onto the bare FeSn surface, which shields the FeSn alloy surface from contact with corrosive media.

U.S. Pat. No. 3,174,917 discloses a method of making tin plate which has a four-layer structure consisting of the steel base, an FeSn layer, an $FeSn_2$-layer and an overlying layer of unalloyed tin. Conventional tinplate exhibits a three-layer structure consisting of the steel base, an $FeSn_2$-layer and an overlying layer of unalloyed tin. The tinplate according to U.S. Pat. No. 3,174,917 or the conventional tinplate does not comprise an organic coating.

As mentioned previously, the heat treatment applied to achieve diffusion-annealing can negatively impact the bulk mechanical properties of the steel substrate, due to ageing effects. It was found possible to improve the bulk mechanical properties of the polymer-coated and FeSn-coated steel substrate after said heat treatment by stretching the material to a small extent (i.e. between 0-3%, preferably at least 0.2%, more preferably at least 0.5%) through e.g. temper rolling or passing the material through a stretcher-leveller. Such a treatment not only serves to improve the bulk mechanical properties (e.g. eliminate/reduce yield point elongation, improve the Rm/Rp ratio, etc.), but can also be used to improve the strip shape (e.g. to reduce the level of bow). Furthermore such a material conditioning process can also potentially be used to modify the surface structure. The substrate is not subjected to extensive reductions during the stretching. The reductions as a result of temper rolling or stretcher-levelling, and the reductions subjected to the material during the production of the packaging applications do not generally cause cracks, and if they form, their presence does not adversely affect the performance of the coated substrate. Since the application of the polymer coating according to the invention involves heating of the substrate, the substrate suffers from ageing due to the diffusion of the interstitial carbon or nitrogen to the dislocations in the substrate. The stretching operation after the polymer coating improves the bulk mechanical properties of the polymer-coated and FeSn-coated steel substrate. In processes wherein the substrate is subjected to a stretching operation prior to polymer coating according to the invention the improvement of the bulk mechanical properties of the polymer-coated and FeSn-coated steel substrate is not achieved because the ageing takes place after the stretching operation has been performed. Moreover, the temper rolling of the polymer coated substrate also prevents stress cracking of the coating from occurring.

In the process according to the invention a steel slab or strip suitable for producing a low-carbon, an extra-low-carbon or an ultra-low-carbon hot-rolled strip for producing packaging steel by hot-rolling at a finishing temperature higher than or equal to the $Ar_3$ transformation point is provided. The impact of diffusion-annealing on the mechanical properties of the bulk steel substrate varies with steel composition, e.g. carbon content of the steel, and mechanical processing history of the material, e.g. amount of cold-rolling reduction, batch or continuous annealing. In case of low carbon steels (which ranges to up to about 0.15 wt. % C, but for packaging purposes is normally up to about 0.05 wt. %) or extra low carbon steels (typically up to about 0.02 wt. % C) the yield and ultimate strength can be affected, as a result of carbon going into solution. Also, a varying amount of yield point elongation is observed after this heat treatment, for CA and BA carbon steel grades.

In an embodiment of the invention, the maximum annealing temperature is limited to 625° C., and preferably the maximum annealing temperature is limited to 615° C.

The inventors found the highest FeSn content in the iron-tin alloy layer was obtained when the annealing temperature was chosen to be at least 550° C.

In a preferred embodiment a process for producing a coated substrate for packaging is provided wherein the time at $T_a$ is at most 4 seconds, preferably at most 2 seconds, and more preferably wherein there is no dwell time at $T_a$. In the latter case the diffusion-annealing takes place by heating the substrate to the peak-metal-temperature of $T_a$ after which the substrate is cooled. The short dwell time at $T_a$ allows the production of the iron-tin alloy layer in an appropriately modified conventional tinplating line.

When diffusion-annealing a full-hard tin-coated substrate the annealing to produce the FeSn-layer simultaneously induces recovery annealing of the microstructure. During the short annealing cycle no recrystallisation of the full-hard substrate takes place. After this combined diffusion/recovery annealing the annealed substrate is cooled rapidly to retain the strength of the recovered microstructure. The reduction in tensile strength and yield strength remains limited due to the short annealing time, but the recovery effect generates a significant increase in elongation values. The process parameters are controlled very carefully because the time-temperature process window for diffusion-annealing is critical in terms of obtaining the desired amounts of FeSn (50:50) in the diffusion alloy layer. As it is this layer that provides the corrosion protection, the control of these parameters is critical. This degree of control of the T-t-profile also ensures that the recovery process, which is a thermally activated process, is reproducible over the length and width of the strip, and from strip to strip.

The term 'recovered microstructure' is understood to mean a heat treated cold-rolled microstructure which shows minimal or no recrystallisation, with such eventual recrystallisation being confined to localised areas such as at the edges of the strip. Preferably the microstructure is completely unrecrystallised. The microstructure of the packaging steel is therefore substantially or completely unrecrystallised. This recovered microstructure provides the steel with a significantly increased deformation capability at the expense of a limited decrease in strength.

In a preferred embodiment the iron-tin alloy layer contains at least 85 wt. % of FeSn, preferably at least 90 wt. %, more preferably at least 95 wt. %. The higher the fraction of FeSn, the better the corrosion protection of the substrate. Although ideally the iron-tin alloy layer consists of FeSn only, it appears to be difficult to prevent the presence of very small fractions of other compounds such as α-Sn, β-Sn, $Fe_3Sn$ or oxides. However, these small fractions of other compounds have been found to have no impact on the product performance in any way.

In an embodiment of the invention a process is provided wherein the annealing is performed in a reducing gas atmosphere, such as HNX, while keeping the coated substrate in a reducing or inert gas atmosphere prior to cooling using non-oxidising or mildly oxidising cooling medium, so as to obtain a robust, stable surface oxide.

In an embodiment of the invention the fast cooling after diffusion-annealing is achieved by means of quenching with water, wherein the water used for quenching has a temperature between room temperature and its boiling temperature. It is important to maintain a homogeneous cooling rate over the strip width during cooling to eliminate the risks of the strip getting deformed due to cooling buckling. This can be achieved by applying cooling water through a (submerged) spray system that aims to create an even cooling pattern on the strip surface. To ensure a homogeneous cooling rate during spraying it is preferred to use cooling water with a temperature between room temperature and 60° C. to prevent that the water reaches boiling temperatures upon contact with the hot steel strip. The latter can result in the onset of localized (unstable) film boiling effects that can lead to uneven cooling rates over the surface of the steel strip, potentially leading to the formation of cooling buckles.

In an embodiment of the invention the annealing process comprises i) the use of a heating unit able to generate a heating rate preferably exceeding 300° C./s, like an inductive heating unit, in a hydrogen containing atmosphere such as HNX, ii) and/or followed by a heat soak which is kept at the annealing temperature to homogenise the temperature distribution across the width of the strip, and/or iii) the annealing process is directly followed by rapid cooling at a cooling rate of at least 100° C./s, and/or iv) wherein the cooling is preferably performed in an reducing gas atmosphere such as a HNX atmosphere, and/or v) the cooling is preferably performed by means of water quenching, by using (submerged) spraying nozzles, wherein the water used for quenching has a minimal dissolved oxygen content and has a temperature between room temperature and 80° C., preferably between room temperature and 60° C., while keeping the substrate with the iron-tin alloy layer(s) shielded from oxygen by maintaining an inert or reducing gas atmosphere, such as HNX-gas, prior to quenching.

In an embodiment of the invention the coating weight of the tin layer or layers onto one or both sides of the substrate is at most 1000 mg/m$^2$, preferably at least 100 and/or at most 600 mg/m$^2$ of substrate surface. This thickness provides adequate protection and keeps the amount of tin used limited.

In an embodiment the thermoplastic polymer coating is a polymer coating system comprising one or more layers comprising the use of thermoplastic resins such as polyesters or polyolefins, but can also include acrylic resins, polyamides, polyvinyl chloride, fluorocarbon resins, polycarbonates, styrene type resins, ABS resins, chlorinated polyethers, ionomers, urethane resins and functionalised polymers, and/or copolymers thereof and/or blends thereof. For clarification:

- Polyester is a polymer composed of dicarboxylic acid and glycol. Examples of suitable dicarboxylic acids include therephthalic acid, isophthalic acid, naphthalene dicarboxylic acid and cyclohexane dicarboxylic acid. Examples of suitable glycols include ethylene glycol, propane diol, butane diol, hexane diol, cyclohexane diol, cyclohexane dimethanol, neopentyl glycol etc. More than two kinds of dicarboxylic acid or glycol may be used together.
- Polyolefins include for example polymers or copolymers of ethylene, propylene, 1-butene, 1-pentene, 1-hexene or 1-octene.
- Acrylic resins include for example polymers or copolymers of acrylic acid, methacrylic acid, acrylic acid ester, methacrylic acid ester or acrylamide.
- Polyamide resins include for example so-called Nylon 6, Nylon 66, Nylon 46, Nylon 610 and Nylon 11.
- Polyvinyl chloride includes homopolymers and copolymers, for example with ethylene or vinyl acetate.
- Fluorocarbon resins include for example tetrafluorinated polyethylene, trifluorinated monochlorinated polyethylene, hexafluorinated ethylene-propylene resin, polyvinyl fluoride and polyvinylidene fluoride.
- Functionalised polymers for instance by maleic anhydride grafting, include for example modified polyethylenes, modified polypropylenes, modified ethylene acrylate copolymers and modified ethylene vinyl acetates.

Mixtures of two or more resins can be used. Further, the resin may be mixed with anti-oxidant, heat stabiliser, UV absorbent, plasticiser, pigment, nucleating agent, antistatic agent, release agent, anti-blocking agent, etc. The use of such thermoplastic polymer coating systems have shown to provide excellent performance in can-making and use of the can, such as shelf-life.

In an embodiment of the invention an additional coating is applied onto the iron-tin alloy layer prior to the polymer coating process, with the aim to reduce the pitting corrosion sensitivity of the FeSn alloy coated substrate, while retaining an excellent adhesion to additionally applied organic coatings.

In an embodiment of the invention the additional coating consists of a Cr—CrOx coating layer, which is deposited onto the iron-tin alloy layer prior to the polymer coating process. This Cr—CrOx coating layer can be applied using the process used to produce Electrolytically Chromium Coated Steels (a.k.a. ECCS). This process is based on plating solutions using hexavalent chromium.

Hexavalent chromium is nowadays considered a hazardous substance that is potentially harmful to the environment and constitutes a risk in terms of worker safety. There is therefore an incentive to develop alternative metal coatings that are able to replace conventional tinplate and ECCS, without the need to resort to the use of hexavalent chromium during manufacturing and minimising, or even eliminating, the use of tin for economical reasons. So therefore, the inventors found that it is particularly advantageous to produce the Cr—CrOx coating layer by depositing the Cr—CrOx-layer in one plating step from a plating solution comprising a mixture of a trivalent chromium compound, a chelating agent, an optional conductivity enhancing salt, an optional depolarizer, an optional surfactant and to which an acid or base can be added to adjust the pH as described in co-pending EP12162415.9 which is herein incorporated by reference. The inventors found that a trivalent chromium plating solution wherein the chelating agent comprises a formic acid anion, the conductivity enhancing salt contains an alkali metal cation and the depolarizer comprises a bromide containing salt, preferably wherein the cationic species in the chelating agent, the conductivity enhancing salt and the depolarizer is potassium, is particularly effective in applying a Cr—CrOx layer in one process step.

It was found that a Cr—CrOx coating produced from a trivalent chromium based electroplating process provides an excellent shielding layer on a FeSn alloy coating. Not only is the electro-catalytic activity of the underlying FeSn alloy layer effectively suppressed, the Cr—CrOx coating layer also provides excellent adhesion to organic coatings. The material according to the invention can be used to replace ECCS for the same applications, as they have similar product features (excellent adhesion to organic coatings, retention of coating integrity at temperatures exceeding the melting point of tin). In addition, the material according to the invention was found to be weldable where ECCS is not.

After the substrate is provided with the FeSn alloy coating layer, the surface can be optionally activated by dipping the material in a sulphuric acid solution, typically a few seconds in a solution containing 50 g/l of sulphuric acid, and followed by rinsing with water prior to application of the Cr—CrOx coating.

In an embodiment of the invention the initial tin coating weight, prior to annealing to form the iron-tin alloy layer is at most 1000 mg/m$^2$, preferably between 100 and 600 mg/m$^2$ of substrate, and/or wherein the chromium metal-chromium oxide layer contains preferably a total chromium content of at least 20 mg Cr/m$^2$, more preferably of at least 40 mg Cr/m$^2$ and most preferably of at least 60 mg Cr/m$^2$ and/or preferably at most 140 mg Cr/m$^2$, more preferably at most 90 mg Cr/m$^2$, most preferably at most 80 mg Cr/m$^2$.

The inventors found that starting at a thickness of the Cr—CrOx coating of ≥20 mg Cr/m$^2$ already results in a significant improvement in comparison to the samples without a Cr—CrOx conversion coating and that starting at a thickness of about 60 mg Cr/m$^2$ the performance is already identical to that of currently marketed products which are produced using Cr(VI)-based solutions.

The Cr—CrOx coating according to the invention provides excellent adhesion to organic coatings such as lacquers and thermoplastic coating layers.

In an embodiment of the invention the composition of the electrolyte used for the Cr—CrOx deposition was: 120 g/l basic chromium sulphate, 250 g/l potassium chloride, 15 g/l potassium bromide and 51 g/l potassium formate. The pH was adjusted to values between 2.3 and 2.8 measured at 25° C. by the addition of sulphuric acid.

Surprisingly, it was found that it is possible to electro-deposit a chromium metal-chromium oxide coating layer from this electrolyte in a single process step. From prior art, it follows that addition of a buffering agent to the electrolyte, like e.g. boric acid, is considered required to enable the electro-deposition of chromium metal to take place. In addition, it has been reported that it is not possible to deposit chromium metal and chromium oxide from the same electrolyte, due to this buffering effect (with a buffering agent being required for the electro-deposition of the chromium metal but excludes the formation of chromium oxides and vice versa). However, it was found that no such addition of a buffering agent was required to deposit chromium metal, provided that a sufficiently high cathodic current density is being applied.

It is believed that a certain threshold value for the current density must be exceeded for the electro-deposition of chromium metal to occur, which is closely linked to the pH at the strip surface reaching certain values as a result of the evolution of hydrogen gas and the equilibration of various (chelated) poly chromium hydroxide complexes. It was found that after crossing this threshold value for the current density that the electro-deposition of the chromium metal-chromium oxide coating layer increases virtually linearly with increasing current density, as observed with conventional electro-deposition of metals, following Faraday's law. The threshold current density is closely linked to the mass transfer conditions at the strip surface: it was observed that this threshold value increases with increasing mass transfer rates. This phenomenon can be explained by changes in pH values at the strip surface: at increasing mass transfer rates the supply of hydronium ions to the strip surface is increased, necessitating an increase in cathodic current density to maintain a specific pH level (obviously higher than the bulk pH) at the strip surface under steady-state process conditions. The validity of this hypothesis is supported by results obtained from experiments in which the pH of the bulk electrolyte was varied between a value of 2.5 and 2.8: the threshold value for the current density decreases with increasing pH value.

Concerning the electro-deposition process of Cr—CrOx coatings from trivalent chromium based electrolytes, it is important to prevent/minimise the oxidation of trivalent chromium to its hexavalent state at the anode. Suitable anode materials consist of graphite, platinised titanium and titanium provided with a mixed metal oxide coating containing iridium oxide and tantalum oxide. In a preferred embodiment the anode consists of a platinised titanium anode.

In an embodiment the iron-tin diffusion layer is provided with a tin metal layer prior to application of the chromium metal-chromium oxide coating, optionally wherein the tin layer is subsequently reflowed prior to application of the chromium metal-chromium oxide coating. Prior to electro-deposition of the tin metal layer onto the FeSn alloy coating, the FeSn surface is optionally activated by dipping the material into a sulphuric acid solution, typically a few seconds in a solution containing 50 g/l of sulphuric acid, and followed by rinsing with water. Prior to the subsequent electro-deposition of the Cr—CrOx coating on the (reflowed) tin metal coating, the tin surface is optionally pre-treated by dipping the material into a sodium carbonate solution and applying a cathodic current at a current density of 0.8 A/dm$^2$ for a short period of time, typically 1 second.

In an embodiment of the invention the substrate for packaging applications which is coated with an iron-tin alloy layer comprising the said amounts of FeSn (50 at. % iron and 50 at. % tin) is provided with a tin layer prior to the application of any additional coating layer, optionally wherein the tin layer was subsequently reflowed prior to the application of such additional coating layer. So in these embodiments an additional tin layer, reflowed or not, is provided between the iron-tin alloy layer and the additional coating layer. The benefits of adding an additional tin layer are the possibility of changing the optical properties of the product and to improve the corrosion resistance of the material. By adding an additional layer consisting of unalloyed tin metal a substrate with a much lighter colour is obtained (i.e. higher L-value), which can be important for decorative purposes. Moreover, the presence of a thin layer (e.g. typically 0.3-0.6 g $Sn/m^2$) of unalloyed tin metal improves the corrosion resistance of the material. By flow-melting this product also the gloss of the coated material can be increased, by reducing the surface roughness of the coated substrate, while this also contributes by even further improving the corrosion resistance through the reduction of porosity of the additional tin layer and the formation of an additional iron-tin alloy, $FeSn_2$, in between the FeSn and unalloyed tin metal layers. In the case where the iron-tin layer is provided with an additional tin layer after the diffusion-annealing it should be noted that the presence of unalloyed tin metal means that this layer can start melting at T≥232° C. (i.e. the melting point of tin), making this embodiment unsuitable for lamination with polymers that require the use of temperatures during processing above 232° C., such as PET.

According to a second aspect, the invention is also embodied in the coated steel substrate for packaging applications comprising

- a recrystallisation-annealed single-reduced steel substrate (SR blackplate), which is optionally temper rolled, or
- a double-reduced steel substrate which was subjected to recrystallisation annealing between the first and second cold-rolling treatment (DR blackplate);

provided on one or both sides with an iron-tin alloy layer which contains at least 80 weight percent (wt. %) of FeSn (50 at. % iron and 50 at. % tin) wherein the iron-tin alloy layer was produced by providing the substrate on the said one or both substrates with a tin layer followed by an annealing step at a temperature $T_a$ of at least 513° C. for an annealing time $t_a$ to form the iron-tin alloy layer and provided with a polymer coating layer on one or both surfaces wherein the polymer coated substrate was subjected to a small plastic deformation by temper rolling or by passing the material through a stretcher-leveller.

Preferred embodiments are provided in the independent claims. Preferred processing conditions are explained hereinabove where the process claims are elucidated. The invention is now further explained by means of the following, non-limiting examples and figures.

Figure 1:
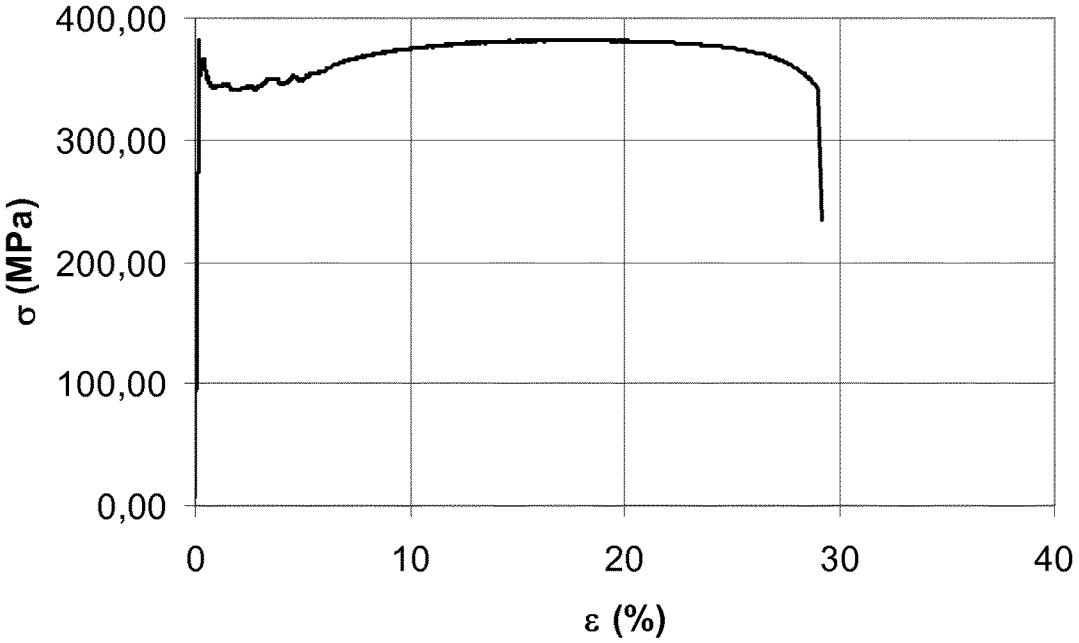
FIG. 1 shows a stress-strain curve of PET coated standard steel substrate and FIG. 2 shows the same after subjecting the PET coated standard steel substrate to a temper rolling reduction of 1%.
Figure 2:
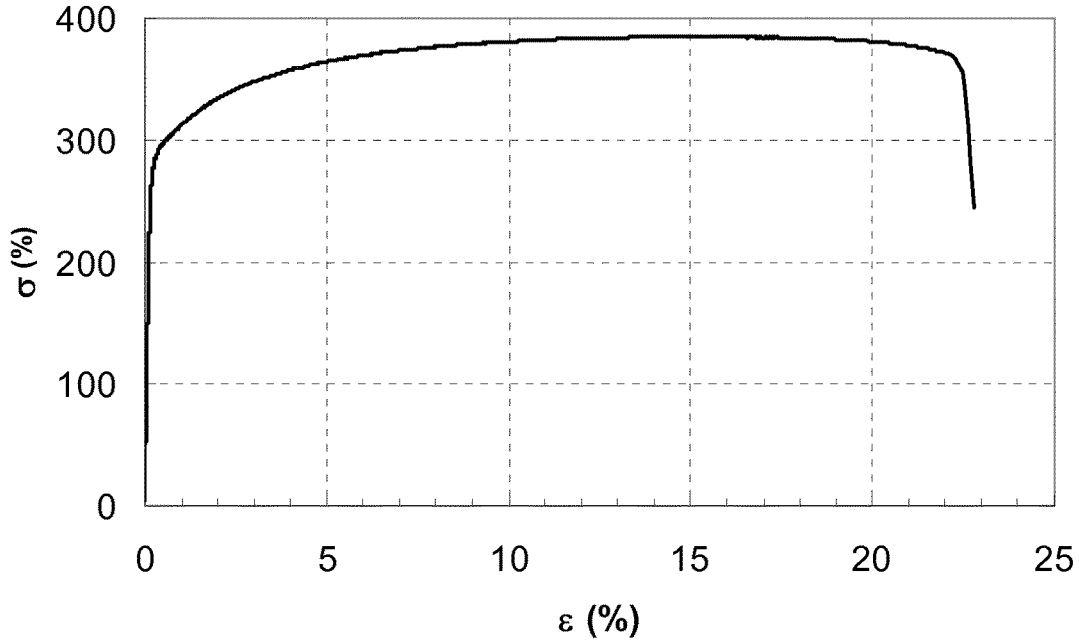
Figure 3:
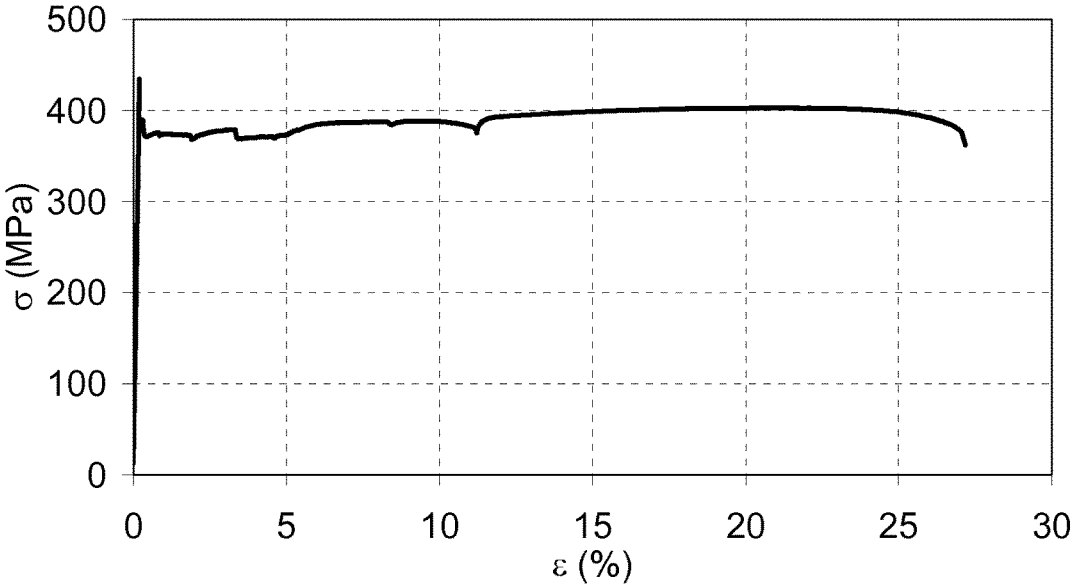
FIG. 3 shows a stress-strain curve of a steel substrate after being exposed to two sequential heat treatments simulating diffusion-annealing & thermal lamination and FIG. 4 shows the same after a temper rolling reduction of 1%.

FIG. 1 shows that the application of a polymer coating on an already temper-rolled SR-CA material results in a yield point elongation ((YPE) i.e. an aged substrate), which YPE can be removed by a second temper-rolling (FIG. 2). FIG. 3 shows what happens if the diffusion annealed substrate is coated with a polymer coating and then subsequently temper rolled: no YPE. In other words: only the temper-rolling (or stretching) of the polymer coated product results in a YPE-free material. Temper rolling only prior to polymer coating does not result in a YPE-free material. This YPE-free substrate is not susceptible to environmental stress cracking, whereas the substrate that is not YPE-free is susceptible to environmental stress cracking

EXAMPLE 1

A PET film was applied by thermal lamination to a standard packaging steel substrate (TH340, continuous annealed SR low carbon steel) provided with a standard ECCS metal coating. These flat sheet polymer-coated materials were subsequently deformed either by Erichsen cupping or putting the material through a Gardner falling dart impact test. Some of the sheets were fed to a laboratory temper mill, reducing the material thickness by 1%, prior to applying the aforementioned deformation.

For the polymer-steel laminates that did not receive a temper mill reduction, after deformation no cracking of the coating was observed visually, even at fairly large deformations as in a 6 mm Erichsen cup. When these deformed samples were left exposed to air, a minor amount of stress cracking did develop over a period of days. When these samples were exposed to a lubricant or wax, stress cracks developed within minutes and continued to grow for several hours. When these samples were exposed to ethanol, extensive stress cracking was observed immediately which did not develop further in time. Thus, the observed behaviour was a true environmental stress cracking (ESC) phenomenon arising from a combination of mechanical stress and contact with chemicals, where certain chemicals are much more aggressive than others.

During the experiments it was noted that deformation in an Erichsen cup is not homogeneous but shows Lüders' lines, in particular in freely deforming areas not supported by the indenter. Stress cracking of the coating appears to develop predominantly in those areas.

It was found that samples that had received a temper mill reduction of 1% prior to deformation did not develop Lüders' lines during Erichsen cupping and showed no signs of environmental stress cracking after exposure to ethanol.

The stress-strain curves of the PET coated steel sheets with and without the temper mill treatment are shown in FIGS. 1 and 2. These Figures clearly show that yield point elongation is effectively suppressed by this stretching operation, which underpins the observation that no formation of Lüders' lines was found for the specimens that received the 1% reduction.

These results demonstrate that ESC of PET coated steel can be suppressed and/or eliminated provided that the material is substantially free from yield point elongation.

This first example focuses on counteracting the effects of material ageing due to a thermal treatment associated with applying a PET film by thermal lamination. However, the inventors found that it is also possible to counteract the material ageing effects of successive heat treatments to which the steel substrate can become exposed during the consecutive application of coating processes, as demonstrated in example 2.

EXAMPLE 2

A standard packaging steel substrate (TH340, continuous annealed low carbon steel, C=0.045%) was exposed to two sequential heat treatments (to which the material would be exposed when manufacturing a thermoplastic coated steel material, in which the steel substrate is provided with a FeSn alloy coating and a Cr—CrOx coating layer prior to application of a thermoplastic coating). The Cr—CrOx coating was applied from the trivalent Chromium plating solution as described hereinabove.

During the diffusion-annealing process the sample was heated to a temperature of 600° C., applying a heating rate of 100° C./s, kept at 600° C. for 2 seconds, cooled back to room temperature by blowing Nitrogen gas, applying a cooling rate of 100° C./s (i.e. $T_a$ 600° C., $t_a$ 2 s) followed by standard thermal lamination of a PET film, including preheating the steel to a temperature of 220° C. to achieve thermal sealing/bonding of the PET film, followed by postheating the substrate to a temperature exceeding 250° C. (above the melting temperature of PET) to modify the properties of the film.

Figure 4:
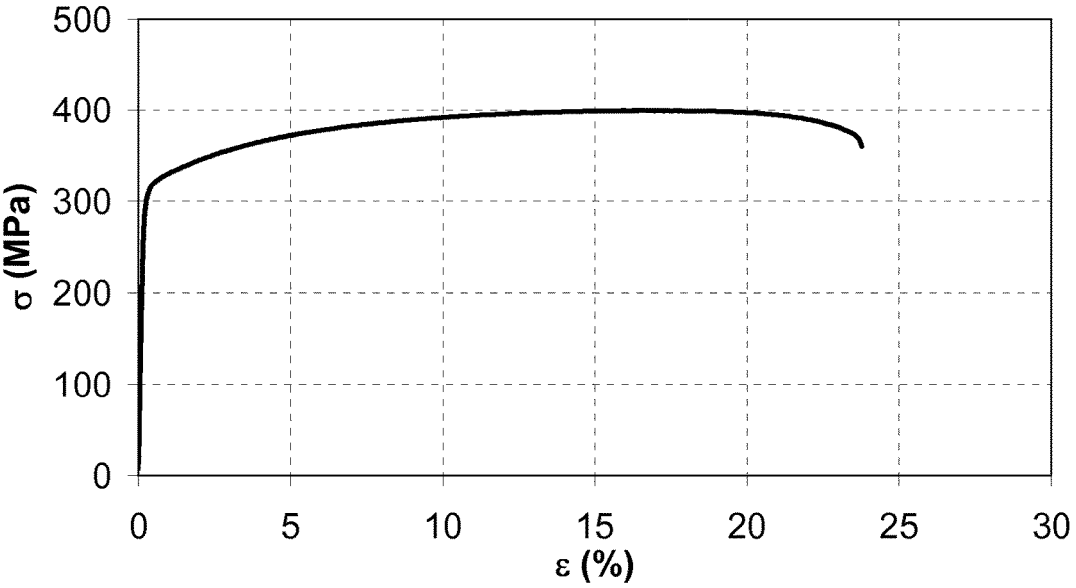

Some of the sheets thus prepared were fed to a laboratory temper mill which reduced the material thickness by 1%. Stress-strain curves were obtained from samples with (FIG. 3) and without (FIG. 4) being exposed to this temper rolling treatment. These results clearly demonstrate that it is possible to successfully counteract the effects of material ageing caused by exposing the bulk steel substrate to the successive thermal treatments associated with diffusion-annealing and thermal lamination. The results in relation to ESC were similar to the samples of Example 1. For ELC and ULC steels which are susceptible to ageing similar results are to be expected.

The invention claimed is:

1. A process for manufacturing a polymer coated steel substrate for packaging applications, comprising the steps of:

providing a steel substrate selected from:

a single-reduced steel substrate, or a double-reduced steel substrate which was subjected to recrystallisation-annealing between the first and second cold-rolling step;

electrodepositing a tin layer on one or both sides of the single-reduced or double-reduced steel substrate to produce a tin-coated steel substrate;

annealing the tin-coated steel substrate at a temperature $T_a$ of at least 513° C. for an annealing time $t_a$ to convert the tin layer into an iron-tin alloy layer which contains at least 80 weight percent (wt. %) of FeSn;

cooling the iron-tin alloy coated substrate at a cooling rate of at least 100° C./s;

applying a polymer coating layer on one or both sides of the iron-tin alloy coated substrate, wherein during the applying of the polymer coating the iron-tin alloy coated substrate is heated;

subjecting the iron-tin alloy coated substrate to a stretching operation at any moment after the polymer coating process wherein the stretching operation is achieved by:

a. passing the iron-tin alloy coated substrate with the polymer coating layer through a temper mill and applying a thickness reduction between 0.2 and 3%; or by b. passing the iron-tin alloy coated substrate with the polymer coating layer through a stretcher-leveller.

2. The process according to claim 1, wherein the iron-tin alloy layer contains at least 85 wt. % of FeSn.

3. The process according to claim 1, wherein the annealing is performed in a reducing gas atmosphere while keeping the coated substrate in a reducing or inert gas atmosphere prior to cooling using non-oxidising or oxidising cooling medium, to obtain a stable surface oxide.

4. The process according to claim 1, wherein the steel substrate is a strip, wherein the fast cooling is achieved by water-quenching, wherein the water used for quenching has a temperature between room temperature and 80° C., and wherein the quenching process is designed to create and maintain a homogeneous cooling rate over the strip width.

5. The process according to claim 1, wherein the steel substrate is a strip, wherein the process comprises at least one feature selected from the group consisting of:

(a) wherein the annealing comprises heating using a heating unit able to generate a heating rate exceeding 300° C./s in a hydrogen containing atmosphere, and optionally the heating is followed by a heat soak kept at the temperature $T_a$ to homogenise temperature distribution across the width of the strip, (b) wherein the cooling is performed in a reducing gas atmosphere, and (c) wherein the cooling is performed by water quenching using submerged spraying nozzles, wherein the water used for the quenching has a temperature between room temperature and 60° C., while keeping the iron-tin alloy coated substrate shielded from oxygen by maintaining an inert or reducing gas atmosphere prior to quenching.

6. The process according to claim 1, wherein coating weight of the tin layer onto one side of the steel substrate, or tin layers respectively onto both sides of the steel substrate, is at most 1000 mg/m$^2$ of the steel substrate surface.

7. The process according to claim 1, wherein the polymer coating layer is an organic coating consisting of a thermoplastic single- or multi-layer polymer coating.

8. The process according to claim 1, wherein an additional coating layer is applied onto the iron-tin alloy layer prior to the polymer coating process, to protect the iron-tin alloy coated substrate against pitting corrosion, while retaining adhesion to additionally applied organic coatings, wherein a tin layer is optionally deposited onto the iron-tin alloy layer prior to the application of the additional coating layer and wherein this tin layer is optionally subsequently reflowed prior to the application of the additional coating layer.

9. The process according to claim 8, wherein the additional coating consists of a Cr—CrOx coating layer, deposited onto the iron-tin alloy layer prior to applying the polymer coating.

10. The process according to claim 9, wherein the Cr—CrOx-layer is deposited in one plating step from a plating solution comprising a mixture of a trivalent chromium compound, a chelating agent, an optional conductivity enhancing salt, an optional depolarizer, and an optional surfactant, and to which an acid or base can be added to adjust the pH.

11. The process according to claim 10, wherein the chelating agent comprises a formic acid anion, the conductivity enhancing salt contains an alkali metal cation, and the depolarizer comprises a bromide containing salt.

12. The process for producing a coated substrate for packaging applications according to claim 1, wherein the stretching operation is achieved by the passing of the material through the temper mill and applying the thickness reduction of 0.2-3%.

13. The process according to claim 1, wherein the iron-tin alloy layer contains at least 90 wt. % FeSn.

14. The process according to claim 4, wherein the water used for quenching has a temperature between room temperature and 60° C.

15. The process according to claim 1, wherein the coating weight of the tin layer onto one side of the steel substrate, or tin layers respectively onto both sides of the steel substrate, is at least 100 and/or at most 600 mg/$m^2$ of the steel substrate surface.

16. The process according to claim 7, wherein the thermoplastic polymer coating is a polymer coating system comprising at least one layer comprising thermoplastic resin selected from the group consisting of polyesters, polyolefins, acrylic resins, polyamides, polyvinyl chloride, fluorocarbon resins, polycarbonates, styrene resins, ABS resins, chlorinated polyethers, ionomers, urethane resins, functionalised polymers thereof, copolymers thereof, and blends thereof.

17. The process according to claim 11, wherein the chelating agent comprises a potassium cation, the alkali metal cation of the conductivity enhancing salt comprises a potassium cation, and the depolarizer comprises a potassium cation.

18. The process according to claim 1, wherein the substrate is a strip, wherein the annealing comprises heating using a heating unit able to generate a heating rate exceeding 300° C./s in a hydrogen containing atmosphere.

19. The process according to claim 18, wherein the heating is followed by a heat soak kept at the temperature $T_a$ to homogenise temperature distribution across the width of the strip.

20. The process according to claim 1, wherein the cooling is performed in a reducing gas atmosphere.

21. The process according to claim 1, wherein the cooling is performed by water quenching using submerged spraying nozzles, wherein the water used for quenching has a temperature between room temperature and 60° C., while keeping the iron-tin coated substrate shielded from oxygen by maintaining an inert or reducing gas atmosphere prior to quenching.

* * * * *